US008590467B2

(12) United States Patent
Tajima et al.

(10) Patent No.: US 8,590,467 B2
(45) Date of Patent: Nov. 26, 2013

(54) CONSTRUCTION OF VERTICAL FULL ROTARY HOOK FOR SEWING MACHINE

(75) Inventors: Ikuo Tajima, Nagoya (JP); Makoto Ishizawa, Tajimi (JP); Hayato Suzuki, Gifu (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 447 days.

(21) Appl. No.: 12/971,248

(22) Filed: Dec. 17, 2010

(65) Prior Publication Data

US 2011/0146550 A1 Jun. 23, 2011

(30) Foreign Application Priority Data

Dec. 21, 2009 (JP) ..... 2009-289327
Jul. 29, 2010 (JP) ..... 2010-170324

(51) Int. Cl.
*D05B 57/14* (2006.01)

(52) U.S. Cl.
USPC ..... 112/228

(58) Field of Classification Search
USPC ..... 112/228, 181, 184, 189, 231, 248
See application file for complete search history.

(56) References Cited

U.S. PATENT DOCUMENTS 2,446,150 A * 7/1948 Wood ..... 112/228
2,548,815 A * 4/1951 Petskeyes ..... 112/228
2,694,373 A * 11/1954 Covert et al. ..... 112/181
3,943,866 A * 3/1976 Bogaert ..... 112/228

FOREIGN PATENT DOCUMENTS

JP 05-039483 U 5/1993

* cited by examiner

*Primary Examiner* — Tejash Patel
(74) *Attorney, Agent, or Firm* — Rossi, Kimms & McDowell LLP

(57) ABSTRACT

An inner rotary hook has a needle drop hole, and side wall portions formed over the drop hole and defining a space for passage therethrough of a sewing needle. The side wall portions are located adjacent to opposite sides of the needle passing through the space and extend from a region in front of the needle to a region behind the needle. The side wall portions can abut against an upper thread, passed through a hole of the needle, near a bottom dead point of the needle. If any of two portions of the thread located forward and rearward of the needle has strayed laterally, it can abut against one of the wall portions. Consequently, it is possible to prevent the front-side upper thread portion from circling around behind the needle, but also prevent the rear-side upper thread portion from straying laterally to form a laterally-protruding loop.

4 Claims, 5 Drawing Sheets

CONSTRUCTION OF VERTICAL FULL ROTARY HOOK FOR SEWING MACHINE

BACKGROUND

The present invention relates to an improved construction of a vertical full rotary hook for a sewing machine where an inner rotary hook is assembled into an outer hook for relative rotation thereto.

FIGS. 10 and 11 show a typical example of the conventionally-known vertical full rotary hooks for sewing machines. The rotary hook shown in FIGS. 10 and 11 comprises an outer rotary hook 21 fixed to a lower shaft 20 rotatable in synchronism with ascending and descending (i.e., up-and-down) movement of a sewing needle, and an inner rotary hook 22 fitted in the outer rotary hook 21. The outer rotary hook 21 has a blade point 23, and the outer rotary hook 21 is driven to rotate in one direction in response to rotation of the lower shaft 20. The inner rotary hook 22 is fitted in the outer rotary hook 21 in such a manner that it is rotatable relative to the outer rotary hook 21 within the outer rotary hook 21. The inner rotary hook 22 has an engaging portion 24 on an outer peripheral region of the front surface thereof, and the engaging portion 24 engages with a rotary hook supporting projection (not shown), fixedly provided on a machine frame, so as to prevent the inner rotary hook 22 from rotating with the outer rotary hook 21. The inner rotary hook 22 has an elongated needle drop hole 25 formed therein. A bobbin case 26 with a bobbin having a lower thread wound thereon is settable within the inner rotary hook 22.

In such a conventionally-known vertical full rotary hook rotary hook, as shown in FIG. 12, a loop L of an upper thread portion, formed rearward of the sewing needle 27 immediately after the sewing needle 27 has started ascending from its bottom dead point, is captured by the blade point 23 of the rotating outer rotary hook 21. Then, after the upper thread has gone around to (i.e., circled around) behind the inner rotary hook 22 in response to the rotation of the outer rotary hook 21, it is removed from the rotary hook by being lifted up via a well-known thread take-up lever at predetermined timing. In this manner, the upper and lower threads intertwine with each other to form a stitch.

When the upper thread is to be captured by the blade point 23 of the outer rotary hook 21 at the time of formation of a stitch, it is necessary that an appropriate upper thread loop L be formed as shown in FIG. 12. However, upper thread portions located forward and rearward, respectively, of the sewing thread 27 may both be undesirably looped as shown in FIG. 3 depending on properties of a fabric and thread used, and thus, the upper thread may be undesirably cut or broken by both of the upper thread portions being captured by the blade point 23.

A more sophisticated vertical full rotary hook designed to avoid such an inconvenience is disclosed in Japanese Utility Model Application Laid-open Publication No. HEI-5-39483 (hereinafter referred to as "the patent literature"), in which a sewing needle insertion groove of a U shape as viewed in plan is provided over the needle drop hole and in which the front and left and right sides of the sewing needle having descended are surrounded by a wall surface of the sewing needle insertion groove. In the disclosed rotary hook having the sewing needle insertion groove, where the three sides, i.e. front and left and right sides, of the sewing needle having descended are surrounded by the wall surface of the sewing needle insertion groove, the upper thread portion located forward of the sewing needle can be prevented from circling around behind the sewing thread 27. In this way, it is possible to prevent both of the upper thread portions from being captured by the blade point 23 of the outer rotary hook and thereby prevent breakage of the thread.

Further, in the vertical full rotary hook disclosed in the patent literature, which has the sewing needle insertion groove over the needle drop hole, the opening end of the sewing needle insertion groove is located substantially in alignment with the center line of the sewing needle as shown in FIG. 2 of the patent literature. However, the opposed side wall surfaces of the insertion groove can only prevent the upper thread portion, located forward of the sewing needle, from circling around behind the sewing needle, and thus, the opposed side wall surfaces of the insertion groove does not at all control the other or rear-side upper thread portion, so that the upper thread passed through the sewing needle may sometimes undesirably deviate or stray laterally depending on the twist of strands of the thread. Consequently, as the sewing needle starts ascending from its bottom dead point under such a condition, the upper thread portion located rearward of the sewing needle 27 may form a loop L1 protruding laterally as shown in FIG. 14. As a consequence, there tends to arise the inconvenience that the loop L1 is not captured by the blade point 23 and fails to form a stitch, or the blade point 23 slightly touches the loop L1 and split the twisted strands of the upper thread to catch and break fibers of the upper thread.

SUMMARY OF THE INVENTION

In view of the foregoing, it is an object of the present invention to provide an improved construction of a vertical full rotary hook for a sewing machine which allows a stitch to be formed reliably and can prevent breakage of a thread.

In order to accomplish the above-mentioned object, the present invention provides an improved vertical full rotary hook for a sewing machine, which comprises: an outer rotary hook; and an inner rotary hook assembled into the outer rotary hook for rotation relative to the outer rotary hook, the inner rotary hook having a needle drop hole formed therein, and a pair of opposed side wall portions formed thereon over the needle drop hole and defining a space for passage therethrough of a sewing needle, the side wall portions located adjacent to opposite sides of the sewing needle passing through the space and each extending from a region in front of the sewing needle over to a region behind the sewing needle.

According to the present invention, the side wall portions, provided on the inner rotary hook over the needle drop hole and defining therebetween the space for passage therethrough of the sewing needle, are located adjacent to the opposite sides of the sewing needle passing through the space and extend from a region in front of the sewing needle over to a region behind the sewing needle. The side wall portions can abut against an upper thread, passed through a hole of the needle, near a bottom dead point of the needle. If any of two portions of the thread located forward and rearward, respectively, of the needle has strayed laterally, it can abut against a corresponding one of the wall portions. Namely, the side wall portions are provided adjacent to the opposite sides of the sewing needle in such a manner that, if any of an upper thread portion passed through the hole (eye) of the sewing needle and located forward of the sewing needle (i.e., front-side upper thread portion connecting to a thread take-up lever side) and another upper thread portion located rearward of the sewing needle (i.e., rear-side upper thread portion connecting to a stitch side) has moved or strayed laterally of the sewing needle, the laterally-strayed upper thread portion can abut against the corresponding side wall portion. Thus, even when the upper thread has moved leftward or rightward due to the twist of strands of the upper thread, the aforementioned structural arrangements can not only prevent the front-side upper thread portion from going around to (i.e., circling around) behind the sewing needle, but also prevent the rear-side upper thread portion from straying laterally to form an undesired laterally-protruding loop. In this way, the present invention allows a stitch to be formed reliably and can prevent breakage of a thread.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF DRAWINGS

For better understanding of the object and other features of the present invention, its preferred embodiments will be described hereinbelow in greater detail with reference to the accompanying drawings, in which.

DETAILED DESCRIPTION

Figure 1:
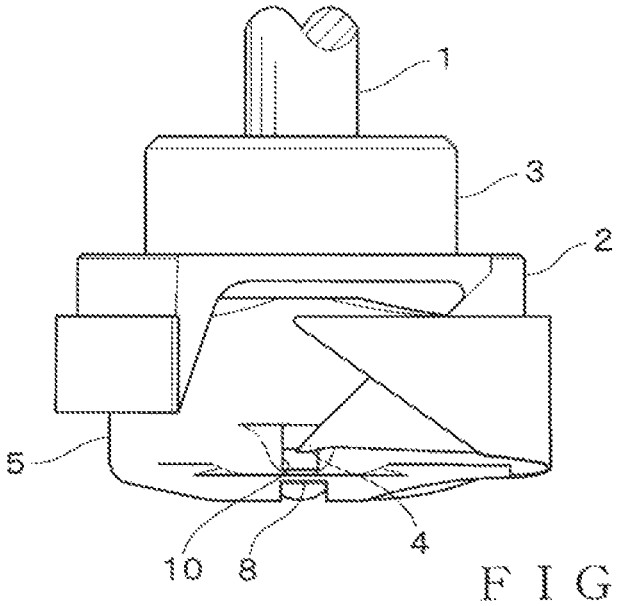
FIG. 1 is a plan view showing a first embodiment of a vertical full rotary hook for a sewing machine of the present invention.
Figure 2:
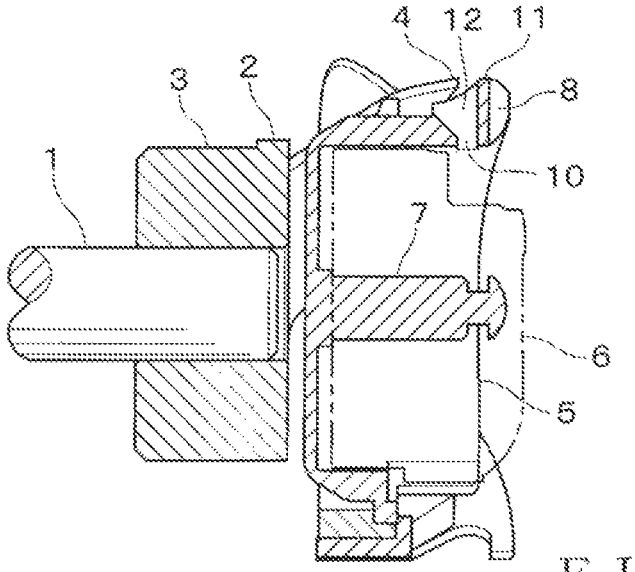
FIG. 2 is a sectional side view showing the first embodiment of the vertical full rotary hook shown in FIG. 1.

FIG. 1 is a plan view showing a first embodiment of a vertical full rotary hook of the present invention, and FIG. 2 is a sectional side view of the first embodiment of the vertical full rotary hook. As clearly seen from these figures, a boss portion 3 of an outer rotary hook 2 is fixed to a rotary hook shaft 1 that rotates in synchronism with ascending and descending movement of a sewing needle during operation of a sewing machine, and the outer rotary hook 2 is driven to rotate together with the rotary hook shaft 1. The outer rotary hook 2 has a blade point (capture portion) 4 for capturing an upper thread loop. An inner rotary hook 5 is assembled into the outer rotary hook 2 for relative rotation thereto. The inner rotary hook 5 has a stud 7 integrally formed on a central portion thereof for supporting a bobbin case 6 in which is rotatably accommodated a bobbin having a lower thread wound thereon.

Figure 4:
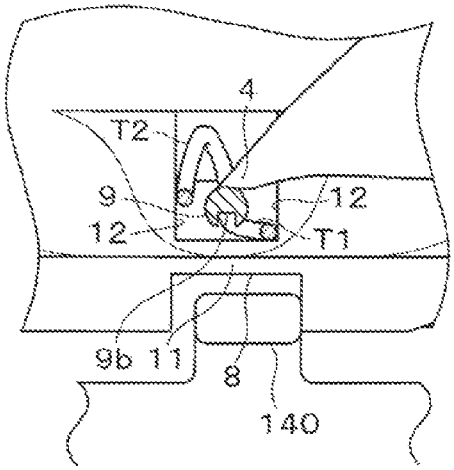
FIG. 4 is a fragmentary enlarged plan view showing the needle drop hole in the first embodiment.

The inner rotary hook 5 has an engaging portion 8 on an outer peripheral region of the front surface thereof, and a rotary hook supporting projection 14 (FIG. 4), fixedly provided on a fixed portion of the sewing machine, is held in engagement with the engaging portion 8. Thus, the inner rotary hook 5 is prevented from rotating as the outer rotary hook 2 is rotated via the rotary hook shaft 1 during operation of the sewing machine. A needle drop hole 10 of a rectangular shape, through which a tip portion of the sewing needle passes, is formed in a portion of the inner rotary hook 5 behind the engaging portion 8.

Figure 3:
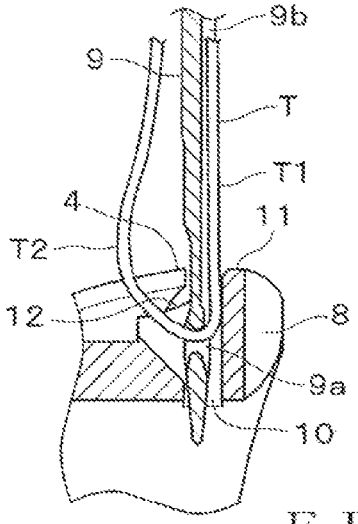
FIG. 3 is a fragmentary enlarged sectional side view showing a needle drop hole in the first embodiment.

FIG. 3 is a fragmentary enlarged sectional side view of the needle drop hole 10, where reference numeral 9 indicates the sewing needle and T indicates the upper thread. The sewing needle 9 is of the well-known construction, which has a needle hole (or eye) 9*a* and a vertical groove 9*b* for receiving therein the upper thread T. The front outer peripheral edge of the needle drop hole 10 is defined by a wall portion 11 of the inner rotary hook 5, and opposed side edges are defined by opposed side wall portions 12 of the inner rotary hook 5. The side wall portions 12 each have an upper end region located above the needle hole (eye) 9*a* of the sewing needle 9 immediately after having started ascending from the bottom dead point (i.e., the sewing needle 9 in a state shown in FIG. 3). Further, each of the side wall portions 12 extends not only forward beyond the centerline of the needle drop hole 10 but also rearward beyond the centerline of the needle drop hole 10; that is, the side wall portions extend from a region in front of the needle 9 over to a region behind the needle 9. Namely, the side wall portions 12 provided over opposed upper portions of the needle drop hole 10 in the inner rotary hook 5 define, in a region over the needle drop hole 10, a space necessary for passage therethrough of the sewing needle 9, and such a space defined by the side wall portions 12 extends forward and rearward beyond the sewing needle 9, passing through the space, along opposite sides of the sewing needle 9. Further, a rear part of each of the side wall portions 12 extending rearward of the sewing needle 9 slants downwardly and rearwardly in order to avoid interference with the blade point 4.

With the aforementioned structural arrangements, the side wall portions 12 can abut against the upper thread T, passed through the hole 9*a* of the sewing needle 9, near the bottom dead point of the sewing needle 9. Thus, if any of the two portions of the upper thread T located forward and rearward, respectively, of the sewing needle 9 has strayed laterally of the sewing needle 9, it can abut against a corresponding one of the side wall portions 12. Namely, the side wall portions 12 are provided adjacent to the opposite sides of the sewing needle 9 in such a manner that, if any of the upper thread portion T1 passed through the hole 9*a* of the sewing needle 9 and located forward of the sewing needle 9 (i.e., front-side upper thread portion T1 connecting to a thread take-up lever side) and the upper thread portion T2 located rearward of the sewing needle 9 (i.e., rear-side upper thread portion T2 connecting to a stitch side) has strayed laterally of the sewing needle 9, the laterally-strayed upper thread portion can abut against the corresponding side wall portion. Thus, even when the upper thread T has moved leftward or rightward due to the twist of strands of the upper thread T, the aforementioned structural arrangements can not only prevent the front-side upper thread portion T1 from going around to behind the sewing needle 9, but also prevent the rear-side upper thread portion T2 from straying laterally to form an undesired laterally-protruding loop.

The following describe how a stitch is formed via the instant embodiment of the vertical full rotary hook. As the sewing needle 9 descends to pierce through a fabric (sewing workpiece), the upper thread portion T1 located forward of the sewing needle 9 enters the vertical groove 9*b* of the sewing needle 9 by being pressed by a portion of the fabric located around the sewing needle 9, while the upper thread portion T2 located rearward of the sewing needle 9 extends along the length of the sewing needle 9. Then, once the sewing needle 9 starts ascending after having arrived at the bottom dead point under the aforementioned condition, an appropriate loop is formed by the rear-side upper thread portion T2 as shown in FIG. 3. The loop formed by the rear-side upper thread portion T2 is captured by the blade point 4 of the rotating outer rotary hook 2, so that a stitch is formed by intertwining between the upper thread T and a lower thread.

The following describe how a stitch is formed on a netted fabric called "tulle". In the case of the tulle fabric, the sewing needle 9, which pierces through the netted fabric, actually pierces through a mesh (small opening) of the netted fabric, and thus, the front-side and rear-side upper thread portions T1 and T2 move away from the sewing needle 9 while also straying laterally of the sewing needle 9 due to the twist of strands of the upper thread T. Then, once the sewing needle 9 starts ascending after having arrived at the bottom dead point under the aforementioned condition, the front-side and rear-side upper thread portions T1 and T2 further stray laterally as shown in a fragmentary enlarged plan view of FIG. 4 and abut against the respective side wall portions 12 so that the lateral straying movement of the front-side and rear-side upper thread portions T1 and T2 is restricted by the side wall portions 12. Further forward movement of the front-side upper thread portion T1 is limited by the wall portion 11 located in front of the upper thread portion T1. Because the further lateral movement of the rear-side upper thread portion T2 is limited by the side wall portion 12 in the manner as noted above, an appropriate loop protruding rearward is formed by the rear-side upper thread portion T2 and captured by the blade point 4. In this way, a stitch is formed reliably and with no thread breakage caused.

Thus, in the case where the fabric is a tulle fabric or the like through which the sewing needle 9 pierces with no or very small resistance, and if the sewing needle 9 has reached the bottom dead point with the upper thread T undesirably straying laterally due to the twist of strands of the fabric, only the upper thread portion T2 located rearward of the sewing needle 9 forms an appropriate loop such that only the upper thread portion T2 is captured reliably by the blade point 4, and thus, a stitch is formed appropriately. As clear from the foregoing, the instant embodiment of the vertical full rotary hook of the present invention is well suited for use in sewing on a fabric, such as a tulle fabric, presenting small resistance when pierced through with the sewing needle. Thus, with the instant embodiment of the vertical full rotary hook, it is possible to reliably form a stitch on any types of fabrics.

It is preferable that the interval or distance between the opposed side wall portions 12 of the inner rotary hook 5 be small in that the undesired lateral straying movement of the upper thread T can be prevented with an increased reliability and allows only the rear-side upper thread portion T2 to be formed in an appropriate loop. However, the distance between the opposed side wall portions 12 cannot be made extremely small for the following reason. The rotary hook supporting projection 140 (FIG. 4), held in engagement with the engaging portion 8 of the inner rotary hook 5 as well known in the art, has a smaller width than the engaging portion 8. The inner rotary hook 5 is more frequently located in a position where the right side surface of the engaging portion 8 and the right side surface of the rotary hook supporting projection 140 abut against each other because of the rotation of the outer rotary hook 2. But, as the upper thread T captured by the blade point 4 of the outer rotary hook 2 passes between the engaging portion 8 and the rotary hook supporting projection 140 by being lifted up by the thread take-up lever after having moved around the inner rotary hook 5, the inner rotary hook 5 pivots in such a direction where the left side surface of the engaging portion 8 and the left side surface of the rotary hook supporting projection 140 abut against each other. Further, the inner rotary hook 5 also pivots leftward and rightward in response to increase and decrease of the rotating speed of the outer rotary hook 2. Thus, the opposed side wall portions 12 of the inner rotary hook 5 have to be spaced from each other by an appropriate distance such that the side wall portions 12 do not interfere with the sewing needle 9 even when the inner rotary hook 5 pivots leftward or rightward. This is the reason why the opposed side wall portions 12 of the inner rotary hook 5 have to be spaced from each other by an appropriate distance as illustratively shown in FIG. 4.

Figure 5:
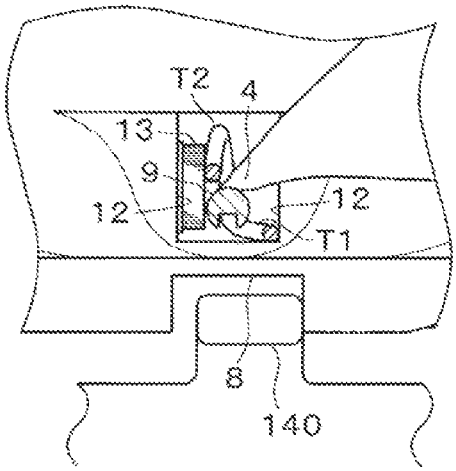
FIG. 5 is a fragmentary enlarged plan view showing a needle drop hole in a second embodiment of the vertical full rotary hook of the present invention.
Figure 6:
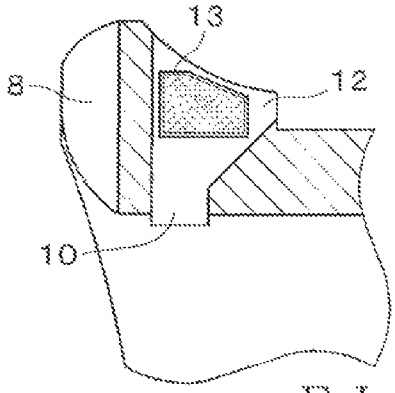
FIG. 6 is a fragmentary enlarged sectional side view showing a needle drop hole in the second embodiment.

FIGS. 5 and 6 show a second embodiment of the vertical full rotary hook of the present invention. The second embodiment of the vertical full rotary hook is constructed in view of the foregoing so as to more reliably prevent the upper thread T from straying laterally and increase the accuracy with which only the upper thread portion T2 located rearward of the sewing needle 9 can be formed in an appropriate loop, by reducing a substantive distance between the opposed side wall portions 12 of the inner rotary hook 5 while securing a sufficient physical distance between the opposed side wall portions 12 for avoiding interference with the sewing needle 9. Namely, in the second embodiment of FIGS. 5 and 6, a napped member 13 is attached to, or provided on, one of the side wall portions 12 (left side wall portion 12 in the illustrated example of FIG. 5). FIG. 5 shows the napped member 13, attached to the side wall portion 12, as viewed from a side thereof, while FIG. 6 shows the napped member 13 as viewed from the front thereof. The napped member 13 comprises, for example, a tape-shaped base, and fibers implanted in the base with an appropriate density in a brush-like manner. Such a napped member 13 is formed of an appropriately-selected material that exhibits physical resistance (becomes an obstacle) to the considerably soft, flexible upper thread T but does not exhibit physical resistance (i.e., exhibits surface flexibility) with respect to the hard sewing needle 9. Thus, when the napped member 13 has interfered with the sewing needle 9 having the thread T passed through the hole 9*a*, the distal ends of the fibers of the napped member 13 function as a substantive wall for preventing the upper thread T from straying laterally, although the fibers of the napped member 13 are pressed back by the hard sewing needle 9. Namely, the napped member 13 limits movement of the upper thread T while permitting passage of the sewing needle 9. Thus, the second embodiment can considerably reduce the interval or distance between the right side wall portion 12 and the left side wall portion 13, having the napped member 13 attached thereto, which act on the flexible upper thread T. As a result, the second embodiment can prevent, with an even further increased reliability, the upper thread T from straying laterally and form only the rear-side upper thread portion T2 into a loop shape. Note that the napped member 13 may be attached to both of the side wall portions 12 rather than only one of the side wall portions 12.

Figure 7:
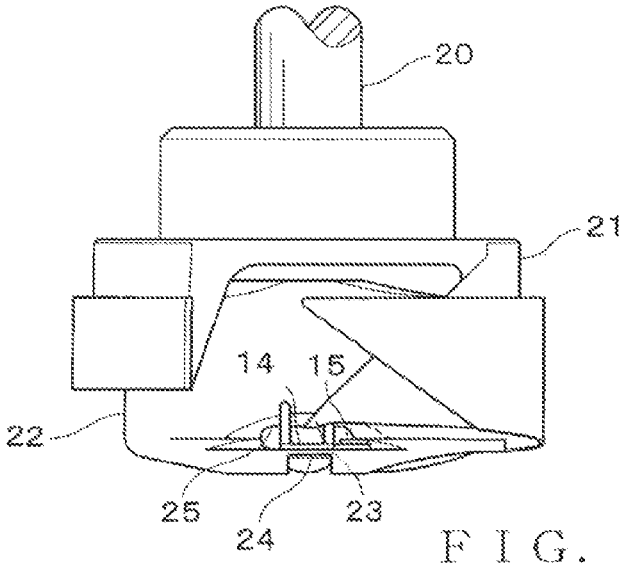
FIG. 7 is a plan view showing a third embodiment of the vertical full rotary hook of the present invention.
Figure 8:
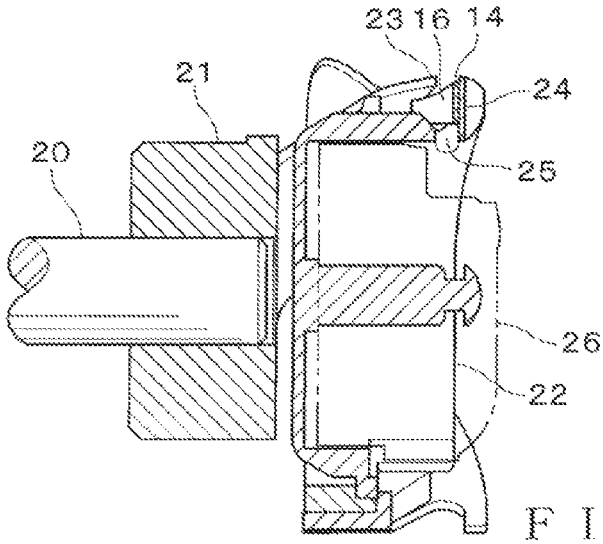
FIG. 8 is a sectional side view of the third embodiment of the vertical full rotary hook.
Figure 9:
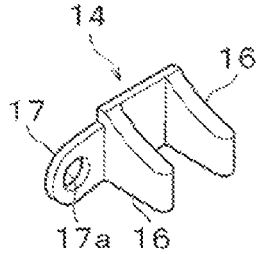
FIG. 9 is a perspective view of a side wall member employed in the third embodiment of the vertical full rotary hook.
Figure 10:
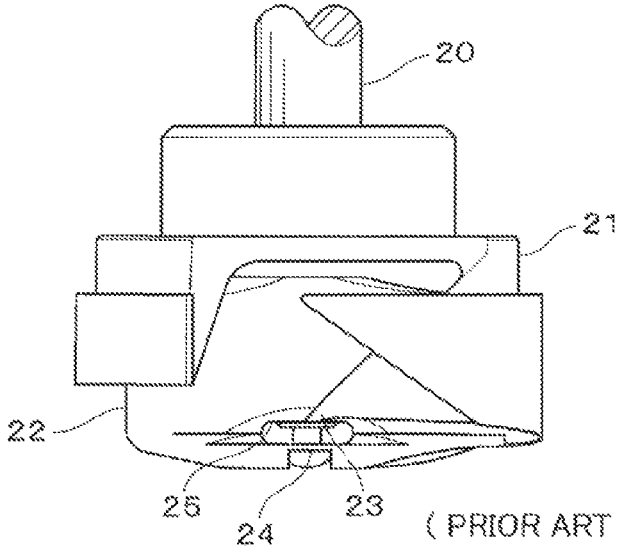
(PRIOR ART) FIG. 10
FIG. 10 is a plan view showing an example of a conventionally-known vertical full rotary hook.
Figure 11:
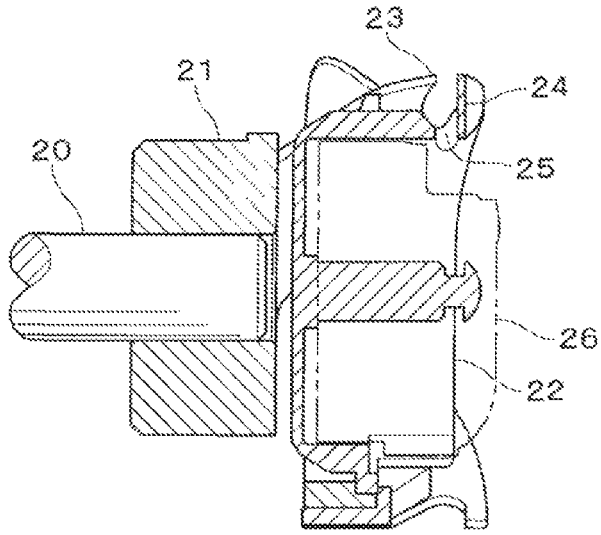
(PRIOR ART) FIG. 11
FIG. 11 is a sectional side view of the vertical full rotary hook.
Figure 12:
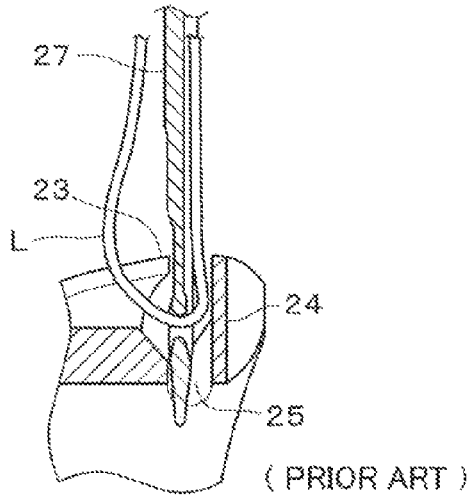
FIG. 12 is a fragmentary enlarged sectional side view showing a needle drop hole in the conventionally-known vertical full rotary hook.
Figure 13:
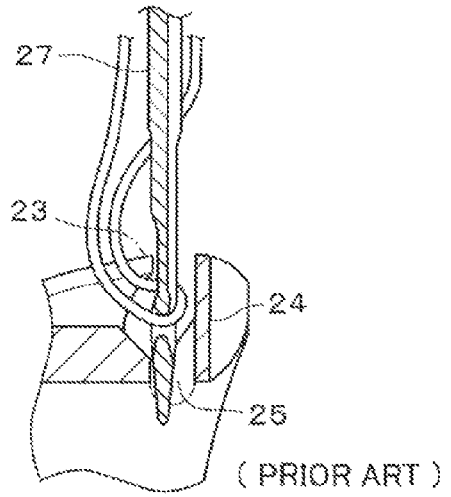
FIG. 13 is a fragmentary enlarged sectional side view showing the needle drop hole in the conventionally-known vertical full rotary hook.
Figure 14:
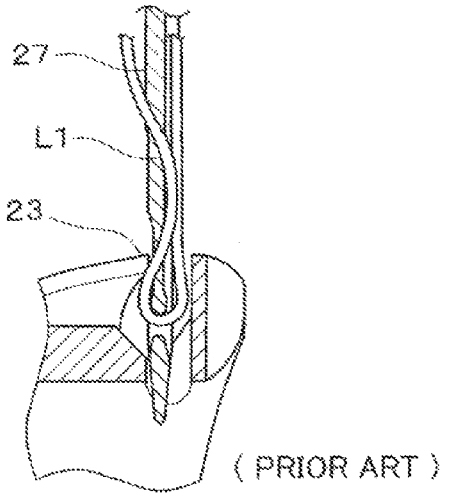
FIG. 14 is a fragmentary enlarged sectional side view showing the needle drop hole in the conventionally-known vertical full rotary hook.

FIG. 7 is a plan view showing a third embodiment of the vertical full rotary hook of the present invention, and FIG. 8 is a sectional side view of the third embodiment of the vertical full rotary hook. In the third embodiment of FIGS. 7 and 8, outer and inner rotary hooks 21 and 22 and needle drop hole 25 are constructed similarly to the outer and inner rotary hooks 21 and 22 and needle drop hole 25 employed in the conventionally-known vertical full rotary hook shown in FIGS. 10 and 11. The third embodiment of FIGS. 7 and 8 is different from the conventionally-known vertical full rotary hook in that a screw hole (female screw) for fixing a side wall member 14 is formed in the inner rotary hook 22 above the needle drop hole 25. The side wall member 14 is detachably fixed or attached to the inner rotary hook 22 by means of a screw (male screw) 15 screwed into the screw hole (female screw). FIG. 9 is a perspective view of the side wall member 14. As shown in FIG. 9, the side wall member 14 includes a pair of opposed side wall portions 16, and a mounting portion 17 having the mounting hole 17*a* formed therein, and the side wall member 14 is fixed to the inner rotary hook 22 by the screw 15 passed through the mounting hole 17*a*. As in the above-described embodiments, the side wall portions 16 can prevent the front-side upper thread portion T1, located forwardly of the sewing needle 9, from circling around behind the sewing needle 9 and prevent the rear-side upper thread portion T2 from laterally straying to form an undesired loop protruding laterally, even when the upper thread T has strayed laterally leftward or rightward due to the twist of strands.

As well known, there are a variety of types of sewing needles so that a suitable one of the sewing needles can be selectively used in accordance with types etc. of a thread and fabric used. Thus, it is preferable that there be prepared a plurality of different types of side wall members 14 having different intervals or distances between the side wall portions 16 suitable for various types of sewing needles 9, and that any one of the side wall members 14 be detachably attached to the inner rotary hook 22 in accordance with the type of the sewing needle 9 to be used. In this way, the third embodiment can prevent, with an even further increased reliability, the upper thread T from straying laterally by selectively using any one of the different types of side wall members 14 which is suitable for any one of various types of sewing. Further, when no side wall member 14 is necessary, the side wall member 14 can be detached from the inner rotary hook 22.

Whereas the third embodiment has been described above as fixing the side wall member 14 to the inner rotary hook 22 by means of the screw 15, the present invention is not so limited, and the side wall member 14 may be fixed to the inner rotary hook 22 in any other desired manner as long as the side wall member 14 is detachable from the inner rotary hook 22. Further, a positioning member may be provided as necessary so that the side wall member 14 can always be fixed to a predetermined position. Furthermore, as in the second embodiment, a napped member 13 may be attached to or provided on at least one of the side wall portions 16.

This application is based on, and claims priorities to, JP PA 2009-289327 filed on 21 Dec. 2009 and JP PA 2010-170324 filed on 29 Jul. 2010. The disclosure of the priority applications, in its entirety, including the drawings, claims, and the specification thereof, is incorporated herein by reference.

What is claimed is:

1. A vertical full rotary hook for a sewing machine, the vertical full rotary comprising:

an outer rotary hook; and an inner rotary hook assembled into said outer rotary hook for rotation relative to said outer rotary hook, wherein said inner rotary hook has a needle drop hole partly defined by a pair of spaced opposed side wall portions providing a space for passage therethrough of a sewing needle, wherein the side wall portions are located adjacent to opposite sides of the sewing needle passing through the space, and each extending from a region in front of the sewing needle over to a region behind the sewing needle, and wherein a rear part of each of the side wall portions extending over to the region behind the sewing needle slants downwardly and rearwardly to avoid interference with a capture portion formed on said outer rotary hook for capturing a loop of an upper thread.

2. A vertical full rotary hook for a sewing machine, the vertical full rotary comprising:

an outer rotary hook; and an inner rotary hook assembled into said outer rotary hook for rotation relative to said outer rotary hook, wherein said inner rotary hook has a needle drop hole partly defined by a pair of spaced opposed side wall portions providing a space for passage therethrough of a sewing needle, wherein the side wall portions are located adjacent to opposite sides of the sewing needle passing through the space, and each extending from a region in front of the sewing needle over to a region behind the sewing needle, and wherein a napped member is provided on at least one of the side wall portions located adjacent to the opposite sides of the sewing needle passing through the space, the napped member exhibiting surface flexibility with respect to the sewing needle but becomes an obstacle to a sewing thread.

3. A vertical full rotary hook for a sewing machine, the vertical full rotary comprising:

an outer rotary hook; and an inner rotary hook assembled into said outer rotary hook for rotation relative to said outer rotary hook, wherein said inner rotary hook has a needle drop hole partly defined by a pair of spaced opposed side wall portions providing a space for passage therethrough of a sewing needle, wherein the side wall portions are located adjacent to opposite sides of the sewing needle passing through the space, and each extending from a region in front of the sewing needle over to a region behind the sewing needle, and wherein the side wall portions are constructed to be detachably attached to said inner rotary hook.

4. The vertical full rotary hook as claimed in claim 3, wherein:

the needle drop hole is further defined by a side wall member, which has the side wall portions, and any one of a plurality of different types of the side wall members is selectively attachable to said inner rotary hook.

* * * * *